United States Patent [19]

Storti

[11] Patent Number: 4,768,686

[45] Date of Patent: Sep. 6, 1988

[54] ADJUSTABLE CEDAR-WOOD HANGER INSERT

[76] Inventor: Henry L. Storti, 463 Bolero Way, Newport Beach, Calif. 92663

[21] Appl. No.: 74,715

[22] Filed: Jul. 17, 1987

[51] Int. Cl.[4] ..... A47G 25/60

[52] U.S. Cl. ..... 223/86; 223/92; 239/60; D6/319; D6/328

[58] Field of Search ..... 223/86, 91, 93, 92; D6/319, 328; 239/60

[56] References Cited

U.S. PATENT DOCUMENTS

| | | | |
|---|---|---|---|
| 536,483 | 3/1895 | Ronner | 223/91 |
| 1,295,480 | 2/1919 | Grant . | |
| 1,615,748 | 1/1927 | Fischer . | |
| 1,741,068 | 12/1929 | Newsom | 223/86 X |
| 1,981,072 | 11/1934 | Roman et al. . | |
| 2,407,015 | 9/1946 | Joseph . | |
| 2,429,919 | 10/1947 | Boorstin . | |
| 2,805,805 | 9/1957 | Orzech et al. | 223/91 |

*Primary Examiner*—Robert R. Mackey
*Attorney, Agent, or Firm*—Milton S. Gerstein

[57] ABSTRACT

An adjustable insert of aromatic cedar wood for insertion into the interior of a clothes hanger to prevent against moths and silverfish. The insert is made up of two relatively adjustable members, both of which are made of aromatic cedar wood, the upper member having a substantially rectangular shape. The two members are adjustable toward and away from each other by a screw and associated knurled nut. The coacting surfaces of the members are formed with grooves for receiving therein respective portions of the interior surfaces of the frame of the hanger.

10 Claims, 1 Drawing Sheet

ADJUSTABLE CEDAR-WOOD HANGER INSERT

BACKGROUND OF THE INVENTION

The present invention is directed to an adjustable insert for clothes hangers made of cedar wood in order to make any closet effectively into a cedar closet by providing some of the hangers used in the closet with the adjustable cedar wood inserts of the invention. There are many prior art cedar wood hanger attachments for providing the scent of cedar wood to a clothes hanger. All suffer from the disadvantage of either not being suitable to any type and size of hanger while still being able to provide a sufficient amount of wood to exude a proper amount of aroma, or must be made initially at the time of the fabrication of the hanger to thus form an integral and inseparable part of the hanger itself. In one case, effective aromatic qualities must be compromised in order to allow for the adaptability of the attachment to more than one hanger type and size, while in the second case, the effective aromatic qualities of the hanger are achieved at the expense of increased cost and lack of transfer ability of the cedar wood, so that when the hanger is broken, old, and the like, the cedar wood becomes useless.

SUMMARY OF THE INVENTION

It is, therefore, the primary objective of the present invention to combine the benefits of both types of prior art to make a cedar wood insert that is adjustable, so that the insert may be used in all types and sizes of hangers, and may be reused over and over again.

It is another objective of the present invention to provide such an adjustable insert that is inexpensive to manufacture, and is simple in construction to allow for such low cost manufacture.

It is an objective of the present invention to provide such a cedar wood insert that although being adjustable and capable of retrofitting to different types and sizes of hangers, contains sufficient cedar wood to exude an aroma sufficient enough to convert a conventional closet into a cedar closet by using only a small amount of inserts of the invention for a like number of hangers to be hung in the closet.

Toward these and other ends, the adjustable cedar wood insert of the invention is comprised of a pair of cedar wood members mounted for relative translational movement with respect to each other. The pair of cedar wood members are insertable as a unit into the very interior of the hanger, which interior is that bounded by the wire, wood, or plastic from which the hanger is made and which defines the shape thereof.

The first, or lower, member is substantially a rectangular piece of cedar wood having a central passageway formed in its upper edge surface. The second, or upper, member is a trapezoidal-shaped piece of cedar wood defining a pair of horizontal bases, and a pair of sloping converging sides, the angle of slope of each being the same and in the preferred embodiment being 23½ degrees, the angle found to be most suitable for universal adaptation to various sizes and shapes of clothes hangers. In the preferred embodiment, the two members are interconnected by a screw affixed at one end to the lower edge surface of the upper member, and slidingly received in the central passageway of the upper edge surface formed in the lower member. A knurled nut is threadingly mounted about the screw between the two members, so that upon rotation of the knurled nut in one direction or the other, the two members are urged toward or away from each other, so that when the two members are positioned in the interior of a clothes hanger and the nut rotated in the other direction, the two members are urged toward the inner surfaces of the hanger proper, to thus force the sloping surfaces of the upper member tightly against the sloping surfaces of the hanger itself, while simultaneous therewith forcing the lower flat surface of the lower member against the inner surface of the horizontal bar of the hanger frame. Thus, the pair of members are held in place.

BRIEF DESCRIPTION OF THE DRAWING

The invention will be more readily understood with reference to the accompanying drawing, wherein.

DETAILED DESCRIPTION OF THE INVENTION

Figure 2:
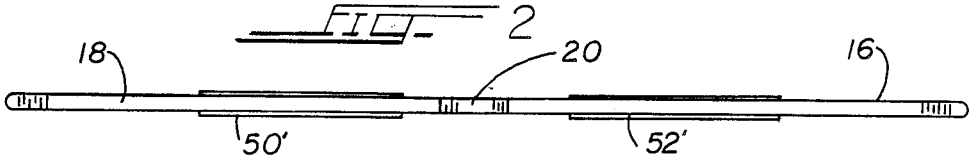
FIG. 2 is a top view thereof.
Figure 1:
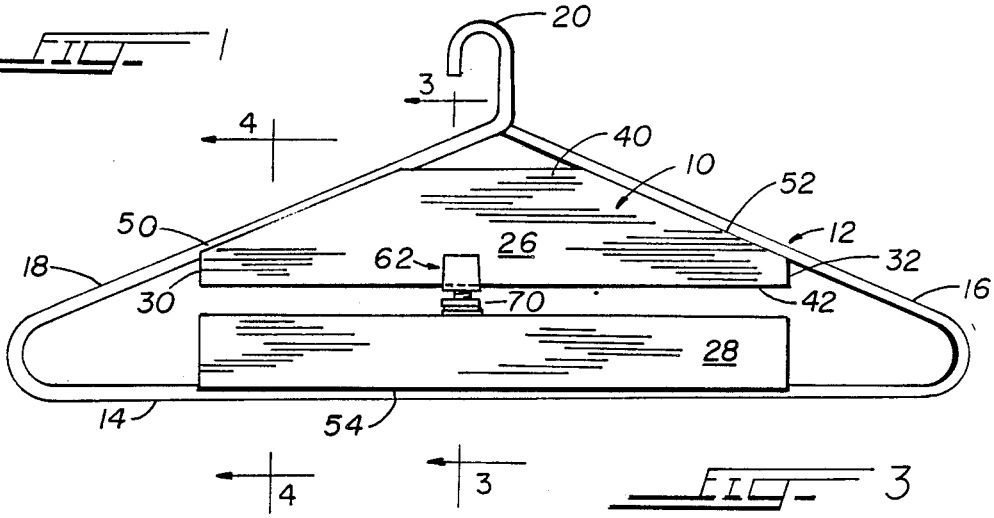
FIG. 1 is a side elevational view of the adjustable cedar wood hanger insert, shown positioned in the interior of a conventional clothes hanger.

Referring now to the drawing in greater detail, there is shown in FIG. 1 the adjustable cedar wood hanger insert, indicated by reference numeral 10, shown positioned in the interior of a clothes hanger 12. The hanger 12 is conventional, and includes a wire, plastic, or wood frame defined by lower horizontal bar 14, inwardly converging and sloping side bars or tubes 16, 18, and a hook member 20. The hollow interior of the hanger 12 is defined by the frame members 14, 16, 18. The cedar wood adapter insert 10 is made up of a pair of insert members or blocks 26, 28. The lower member or block 28 is substantially rectangular in cross section, while the upper member or block 26 is substantially trapezoidal in cross section, except for the truncated flat surfaces 30, 32. The two members 30, 32 are mounted for relative translational movement with respect to each other so that the insert 10 may fit the size and shape of conventional clothes hangers. The upper member 26 includes an upper flat surface 40, a lower flat surface 42, both upper and lower surfaces lying substantially in horizontal planes, and a pair of converging, inwardly-sloping side surfaces 50, 52. In the preferred embodiment, the angle of slope of each side surface 50, 52 is 23½ degrees, the angular slope of most conventional clothes hangers. The range of slope for each side surface 50, 52 is between 17 degrees and 28 degrees, with each side surface taking on a value within that range, and not necessarily the same value, so that the angle of slope of each side surface may be different from the other. This difference between the two side surfaces is especially useful since many clothes hangers are somewhat flexible and therefore allows for conformity of the hanger to suit the slope of the side surfaces.

Figure 3:
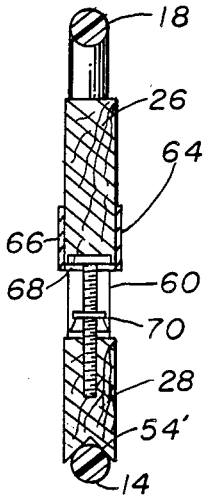
FIG. 3 is a cross-sectional view taken along line 3—3 of FIG. 1.

The two members 26, 28 are connected to each other via a threaded element or screw 60 best seen in FIG. 3. The lower portion of the upper member 26 is provided with a U-shaped bracket 62 having parallel legs 64, 66 and base portion 68. The bracket 60 is fixedly attached to the upper member via its two legs by any conventional means to the faces of the upper member 26. The base portion 68 has a central opening through which passes the shank of the screw, which central opening has a diametric extension less than the head of the screw 60, to thus secure the head and screw to the upper member 26 so that no relative rotational or translational movement occurs therebetween. The upper horizontal edge surface of the lower member 28 is also provided with a central passageway or hole into which extends the shank of the screw 60, which central passageway is nonthreaded, so that the screw 60 may slide therein as the two halves or members 26, 28 are moved relative to each other in a direction parallel to the length of the shank. A knurled nut 70 threadingly receives therethrough the threaded shank of the screw 60, so that when the knurled nut 70 is rotated in a first direction, it moves downwardly along the threaded shank until it abuts up against the upper edge surface of the lower member 28. Upon continued rotation in the first direction, it forces the lower member 28 downwardly away from the upper member 28, with the screw shank moving in the central passageway to accomodate such relative movement. Upon rotation of the knurled nut 70 in a second, opposite direction, it is spaced from the upper edge surface of the lower member 28 to thereby allow for the upward movement of the lower member toward the upper member, with the concomitant movement of the shank of the screw 60 further into the central passageway of the lower member. Thus, it may be seen that the upper and lower members are mounted for relative translational movement while being positioned in the interior of the frame of the hanger.

In using the cedar wood insert 10, the screw 60 projecting downwardly from the lower edge surface of the upper member 26 is inserted into the central passageway formed in the upper edge surface of the lower member 28. The knurled nut 70 is rotated in the second direction until the shank of the screw is positioned substantially along a major portion of the central passageway, so as to position the two members for insertion into the interior of the hanger. After insertion into the interior of the hanger, in the manner depicted in FIG. 1, the knurled nut 70 is rotated in the first direction to thereby abut against the upper edge surface of the lower member 28, and is continued to be rotated to move the lower member 28 relative to the screw 60, such rotation continuing until a snug and tight fit is achieved by the coacting surfaces of the upper and lower members and the interior surfaces of the frame of the hanger. If desired, one may simply remove the insert 10 by rotating the knurled nut 70 in the second direction to allow a lower member 28 to move upwardly relative to the screw 60. It is noted that insertion of the insert 10 is considerably facilitated by the flexible nature of the clothes hanger when such is made of plastic, wire, and other flexible material.

Figure 4:
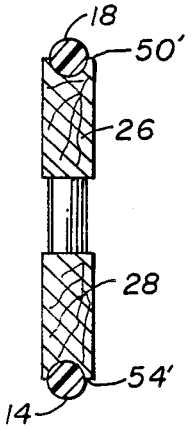
FIG. 4 is a cross-sectional view taken along line 4—4 of FIG. 1.

In the preferred form of the invention, each of the coacting surfaces 50, 52 of the upper member 26, and the lower horizontal coacting surface 54 of the lower member 28 are provided with substantially cutout surfaces so as to define for each coacting surface a pair of converging V-shaped grooves therein, as shown as numerals 50', 54' in FIG. 4, so as to receive snugly therein the juxtapositioned frame element or tube 14, 16, and 18, respectively, to thus provide a dovetailed-like connection. Such dovetailed-like connection provides a more reliable and permanent interrelationship between the insert 10 and its associated hanger.

In the preferred form of the invention, the upper member 26 as well as the lower member 28 has an overall length of 10½ inches. The lower member 28 has a width of 1 inch, with each of the flat surfaces 30, 32 also being one inch in width as taken in the direction parallel to the length of the screw 60. The trapezoidal height of the upper member 26 is 2½ inches. The dovetailed-like groove of each of the coacting surfaces 50, 52, 54 is formed by two converging surfaces forming an angle of 90 degrees and the thickness of each upper and lower piece member 26 and 28 is 5/16th inch. The hole or screw 60 is one inch long while the length of the central passageway is 13/32 of an inch.

While it has been shown that the U-shaped bracket 62 and associated screw 60 are nonslidingly affixed to the upper member 26, it is to be understood that they may be attached to the upper edge surface of the lower member 28, with the central passageway for the screw being appropriately provided in the lower edge surface of the upper member 26, with the nut 70 operating in the same manner to cause relative sliding movement between the members 26, 28, to effect the same result. The cedar wood inserts 10 will provide an aroma to a closet to effectively convert it into a cedar closet to thereby repel moths and silverfish. Upon lapse of a specified time, when the aroma thereof wanes, the insert members 26 and 28 may be given a new aromatic scent by simply sanding the faces of the members 26, 28, lightly. Thus, the shape and design of the members 26 and 28, by providing surface area that is largely made up of the faces of the members, is ideally suited to the refreshening process of sanding. It is also noted that the attachment of the U-shaped bracket 62 may be by way of a simple press fit via the two legs 64, 66, although it is to be understood that any manner or structure may be used for nonslideably mounting the screw or bolt 60 to the member 26 or 28 to which it is affixed.

While a specific embodiment of the invention has been shown and described, it is to be understood that numerous changes and modifications may be made therein without departing from the scope, intent and spirit of the invention as set forth in the appended claims.

What I claim is:

1. A combined cedar wood insert and hanger comprising:

a first lower piece of cedar wood;

a second upper piece of cedar wood;

at least one of said first and second pieces of cedar wood being aromatic cedar wood;

means for mounting said first and second pieces for relative translational movement;

a clothes hanger comprising a lower horizontal frame member, and a pair of sloping side frame members, said lower piece comprising a lower horizontal edge surface pressing against the interior surface of said lower horizontal frame member, and said upper piece comprising a pair of sloping edge surfaces pressing against the interior surfaces of said pair of sloping side frame members.

2. A cedar wood insert for a coat hanger, or the like, comprising:

a first lower piece;

a second upper piece;

at least one of said first lower piece and said second upper piece being made of aromatic cedar wood;

means for mounting said first and second pieces for relative translational movement so that when said pieces are positioned in the interior of a hanger frame, said means for mounting allows relatively outward movement of said pieces to thereby secure in place the insert in the interior of the hanger;

said first lower piece being substantially rectangular, and said second upper piece being substantially trapezoidal defining a lower horizontal edge surface and an upper shorter horizontal edge surface and a pair of converging sloping side edge surfaces;

said means for mounting comprising a screw means mounted in nonsliding and nonrotatable manner in one of said first and second pieces, said screw means projecting outwardly from the horizontal edge surface of said one piece, which horizontal edge surface faces the other of said first and second pieces, said other of said first and second pieces having a central passageway formed in the horizontal edge surface thereof facing said horizontal edge surface of said one of said first and second pieces, said screw means being slidably positionable in said central passageway to allow for relative translational movement between said pieces, and nut means threadingly associated with said pieces, said nut means being mounted about said screw means between said facing horizontal edge surfaces when said screw means is positioned partially within said central passageway.

3. The insert according to claim 2, wherein the angle of slope of each said side edge surface is between 17 and 28 degrees.

4. The insert according to claim 3, wherein the angle of slope is 23½ degrees.

5. The insert according to claim 4, wherein each of said first and second pieces is made of aromatic cedar wood.

6. The insert according to claim 2, wherein each of said first and second pieces is made of aromatic cedar wood.

7. The insert according to claim 2, wherein said means for mounting further comprises fastening means for fastening said screw means to said one of said first and second pieces in nonsliding and nonrotatable manner.

8. The insert according to claim 7, wherein said means for fastening comprises a U-shaped bracket means having a pair of parallel leg portions and a base portion, said leg portions sandwiching therebetween said one piece along the thickness thereof, and said base portion having a hole therethrough, said screw means comprising a shank portion extending through said hole, and a head portion of greater diametric extent than the diametric extent of said hole, to thereby affix said screw means to said one piece.

9. A cedar wood insert for a coat hanger, or the like comprising:

a first lower piece;

a second upper piece;

at least one of said first lower piece and said second upper piece being made of aromatic cedar wood;

means for mounting said first and second pieces for relative translational movement so that when said pieces are positioned in the interior of a hanger frame, said means for mounting allows relatively outward movement of said pieces to thereby secure in place the insert in the interior of the hanger;

said first lower piece being substantially rectangular, and said second upper piece being substantially trapezoidal defining a lower horizontal edge surface and an upper shorter horizontal edge surface and a pair of converging sloping side edge surfaces;

said pair of sloping side edge surfaces of said second upper piece and the lower horizontal edge surface of said first lower piece each comprising a dovetail-like cutout for receiving therein an interior surface portion of a respective frame member of a clothes hanger, to provide a snug, tight fit thereby.

10. The insert according to claim 9, wherein each said cutout is defined by a pair of converging sloping surfaces forming a 90 degree angle therebetween.

* * * * *